US010959905B2

(12) United States Patent
Xi et al.

(10) Patent No.: US 10,959,905 B2
(45) Date of Patent: Mar. 30, 2021

(54) RADIO COMMUNICATION DEVICE AND A RFID DEVICE FOR ASSISTING VISUALLY IMPAIRED USERS

(71) Applicant: Hong Kong R&D Centre for Logistics and Supply Chain Management Enabling Technologies Limited, Pok Fu Lam (HK)

(72) Inventors: Jing Tian Xi, Pok Fu Lam (HK); Man Kit Wong, Pok Fu Lam (HK)

(73) Assignee: Hong Kong R&D Centre for Logistics and Supply Chain Management Enabling Technologies Limited, Pok Fu Lam (HK)

( * ) Notice: Subject to any disclaimer, the term of this patent is extended or adjusted under 35 U.S.C. 154(b) by 0 days.

(21) Appl. No.: 16/493,558

(22) PCT Filed: Mar. 15, 2017

(86) PCT No.: PCT/CN2017/076757
§ 371 (c)(1),
(2) Date: Sep. 12, 2019

(87) PCT Pub. No.: WO2018/165898
PCT Pub. Date: Sep. 20, 2018

(65) Prior Publication Data
US 2020/0009004 A1 Jan. 9, 2020

(51) Int. Cl.
*G08C 19/12* (2006.01)
*A61H 3/06* (2006.01)
*H01Q 19/30* (2006.01)

(52) U.S. Cl.
CPC ..... *A61H 3/061* (2013.01); *A61H 3/066* (2013.01); *H01Q 19/30* (2013.01)

(58) Field of Classification Search
CPC ..... A61H 3/061; A61H 3/066; H01Q 19/30
USPC ..... 340/13.26
See application file for complete search history.

(56) References Cited

U.S. PATENT DOCUMENTS 5,936,528 A * 8/1999 Kobayashi ..... A61H 3/061 340/572.5
6,867,697 B2 * 3/2005 Nanayakkara ..... A61H 3/061 340/4.11
7,242,518 B1 * 7/2007 Lynch ..... H01Q 3/46 330/286
8,259,032 B1 * 9/2012 Buckley ..... H01Q 1/40 343/909
9,755,306 B1 * 9/2017 Ogilvie ..... H01Q 9/0414
(Continued)

FOREIGN PATENT DOCUMENTS

CN 104234367 12/2014
CN 104306139 1/2015
CN 106456373 2/2017

*Primary Examiner* — Kerri L McNally
*Assistant Examiner* — Thang D Tran
(74) *Attorney, Agent, or Firm* — Renner, Kenner, Greive, Bobak, Taylor & Weber

(57) ABSTRACT

A radio communication device comprising a planar body arranged to be inserted into a gap portion between one or more construction components, wherein the planar body includes a radio communication chip and an antenna arrangement arranged to substantially radiate radio communication signals from the radio communication chip in a direction away from the gap portion.

10 Claims, 5 Drawing Sheets

(56) References Cited

U.S. PATENT DOCUMENTS

2004/0069984 A1* 4/2004 Estes ..... G02B 6/4201 257/25
2005/0099307 A1* 5/2005 Gilfix ..... A61H 3/061 340/573.1
2005/0127500 A1 6/2005 Colgan et al.
2006/0180647 A1* 8/2006 Hansen ..... B60S 3/00 235/375
2007/0069021 A1* 3/2007 Elrod ..... G06K 17/00 235/451
2008/0107481 A1* 5/2008 Donald ..... E01C 5/20 404/9
2010/0318440 A1* 12/2010 Coveley ..... G07G 1/0036 705/26.1
2011/0273360 A1* 11/2011 Campero ..... H01Q 1/2216 343/893
2011/0300516 A1* 12/2011 Wigdor ..... G09B 21/007 434/116
2011/0315880 A1* 12/2011 Nemirovsky ..... G01J 5/024 250/340
2012/0075072 A1* 3/2012 Pappu ..... H04B 5/0062 340/10.1
2013/0221111 A1* 8/2013 Kaga ..... G06K 19/041 235/492
2013/0300624 A1* 11/2013 Fakharzadeh Jahromi ..... H01Q 9/065 343/793
2013/0313328 A1* 11/2013 Mohajer-Iravani .... H01Q 13/18 235/492
2014/0368396 A1* 12/2014 Shinkai ..... H01Q 1/38 343/817
2015/0024549 A1* 1/2015 Colgan ..... H01L 25/0657 438/109
2015/0171522 A1* 6/2015 Liu ..... H01Q 5/42 343/796
2016/0008708 A1* 1/2016 Bittner ..... A63F 9/0612 273/293
2016/0056544 A1* 2/2016 Garcia ..... H01Q 1/38 343/725
2016/0085518 A1* 3/2016 I ..... G06F 8/34 717/105
2016/0352000 A1* 12/2016 Ohno ..... H01Q 9/065
2016/0361662 A1* 12/2016 Karunaratne ..... G06F 3/038
2017/0165147 A1* 6/2017 Ng ..... G01S 5/0284

* cited by examiner

RADIO COMMUNICATION DEVICE AND A RFID DEVICE FOR ASSISTING VISUALLY IMPAIRED USERS

TECHNICAL FIELD

The present invention is related to a radio communication device and a RFID device for assisting visually impaired users, and particularly, although not exclusively, to a radio communication device which is generally arranged to be placed in between flooring components.

BACKGROUND

In order to assist visually impaired persons to navigate around buildings and paths, builders and engineers have used tactile guiding tiles so as to provide navigational assistance to these persons. These tactile guiding tiles are usually made from different materials such as rubber, plastics or metal and provide a uniform physical feel so that users can use a cane or other tactile member to feel for these tiles.

Although generally useful to visually impaired users, these tactile tiles have not been updated to take advantage of the information revolution. Additional navigation information that can be electronically delivered to users cannot be performed with these tactile tiles. Although there are developments to deploy large scale electronic devices on roadways and around various buildings and infrastructure so as to provide electronic information delivery, the cost to deploy such electronic equipment in every street and building is very expensive and time consuming.

SUMMARY OF THE INVENTION

In accordance with a first aspect of the present invention, there is provided a radio communication device comprising:

a planar body arranged to be inserted into a gap portion between one or more construction components, wherein the planar body includes a radio communication chip and an antenna arrangement arranged to substantially radiate radio communication signals from the radio communication chip in a direction away from the gap portion.

In an embodiment of the first aspect, the radio communication signals are radiated primarily in a single direction.

In an embodiment of the first aspect, the single direction is upwards from a ground surface or outwards from a ceiling or wall surface.

In an embodiment of the first aspect, the direction away from the gap portion is parallel with a longitudinal axis of the gap portion.

In an embodiment of the first aspect, the planar body has a substantially thin profile so as to be inserted into the gap portion.

In an embodiment of the first aspect, the one or more construction components include tiles or bricks.

In an embodiment of the first aspect, the gap portion is defined by the cavities formed in between bricks or tiles which are placed on a surface or wall to cover the surface or wall.

In an embodiment of the first aspect, the antenna arrangement is arranged to radiate communication signals substantially in one direction.

In an embodiment of the first aspect, the antenna arrangement is an end-fire array antenna.

In an embodiment of the first aspect, the end-fire array antenna is disposed onto the planar body.

In an embodiment of the first aspect, the end-fire array antenna is defined on the planar body with a feeder element connected to the radio communication chip, a reflector element and/or a director element.

In some embodiments, the director and the reflector may not necessarily exist at the same time. In these example embodiments, where there is either only a director or a reflector, the uni-directional radiation can still be achieved although the directivity may be slightly lower. However, more directors can also be used if a higher directivity (more uni-directional radiation) is required.

In an embodiment of the first aspect, the feeder element, reflector element and/or director element are arranged as a yagi antenna.

In accordance with a second aspect of the present invention, there is provided a RFID device for assisting visually impaired users comprising:

a planar body arranged to be inserted into a gap portion between one or more flooring components covering a ground surface, wherein the planar body includes a radio communication chip and an antenna arrangement arranged to substantially radiate radio communication signals from the RFID chip upwardly in a direction away from the ground surface.

In an embodiment of the second aspect, the antenna arrangement is arranged to radiate communication signals substantially in one direction.

In an embodiment of the second aspect, the antenna arrangement is an end-fire array antenna.

In an embodiment of the second aspect, the one or more flooring components include tactile guiding tiles.

In an embodiment of the second aspect, the RFID chip is arranged to communicate with a device arranged to use an RFID arrangement to assist a visually impaired person.

In an embodiment of the second aspect, the RFID device is arranged to be placed adjacent to a tactile guiding tile.

In accordance with a third aspect of the present invention, there is provided a method for installing a RFID device into a surface comprising the step of: Placing the RFID device into a gap between two or more abutting flooring components, wherein the RFID device is substantially planar and is arranged to radiate a radio signal substantially in a direction away from the surface.

BRIEF DESCRIPTION OF THE DRAWINGS

Embodiments of the present invention will now be described, by way of example, with reference to the accompanying drawings in which.

DETAILED DESCRIPTION OF THE PREFERRED EMBODIMENT

Figure 1:
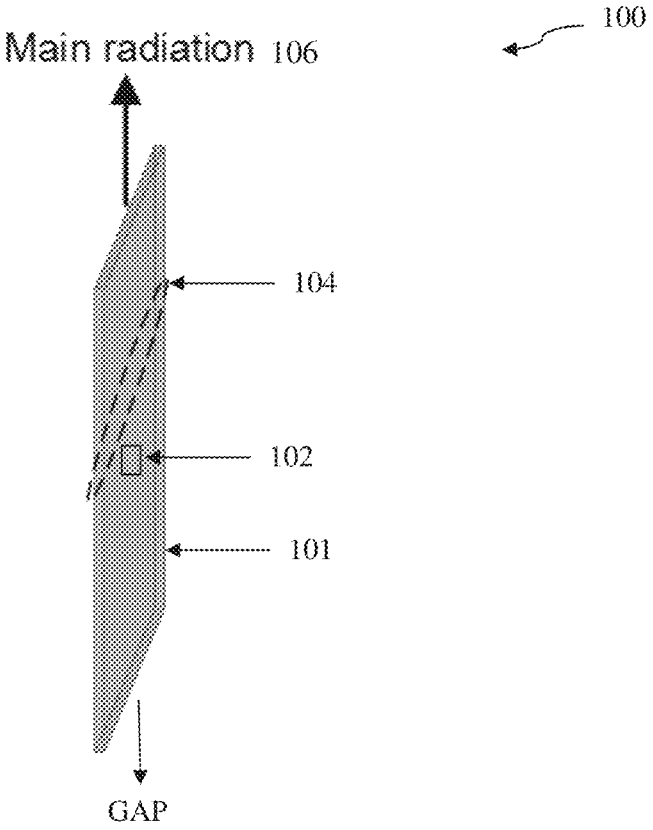
FIG. 1 is an illustration of a radio communication device in accordance with one embodiment of the present invention.

With reference to FIG. 1, there is illustrated an embodiment of a radio communication device 100 comprising: a planar body 101 arranged to be inserted into a gap portion between one or more construction components, wherein the planar body 101 includes a radio communication chip 102 and an antenna arrangement 104 arranged to substantially radiate radio communication signals 106 from the radio communication chip 102 in a direction away from the gap portion.

In this embodiment, the radio communication device 100 comprises a generally planar body 101 which is preferably made from a non-conductive substrate such as plastic or epoxy. On this planar body 101 is placed a radio communication arrangement which may include a radio communication chip 102 and an antenna arrangement 104 so as to transmit or receive any radio communication signals 106.

In this embodiment, the planar body 101 is generally thin in profile such that the entire planar body 101 may take the shape and profile of a card member. This is advantageous in that the planar body 101 can in turn be installed into narrow gaps that can exist in between construction component, such as bricks, tiles or small and thin cavities in between flooring components such as panels or skirts. Once installed into these gaps or cavities, the radio communication device 100 can then either receive or transmit (or both) signals to an external reader device. Thus in one example usage, the radio communication device 100 can be installed in between flooring components, such as floor bricks or tiles that are laid onto a surface, and in turn, the radio communication device 100 can communicate with an external reader such as a smartphone, a smart cane (a cane with a reader and a communication interface) or another communication devices so as to convey information to a user of the external reader. In examples where the user is a visually impaired person, the radio communication device 100 may convey navigation information to the user's external reader to assist them with navigating around their surroundings.

Figures 2A, 2B:
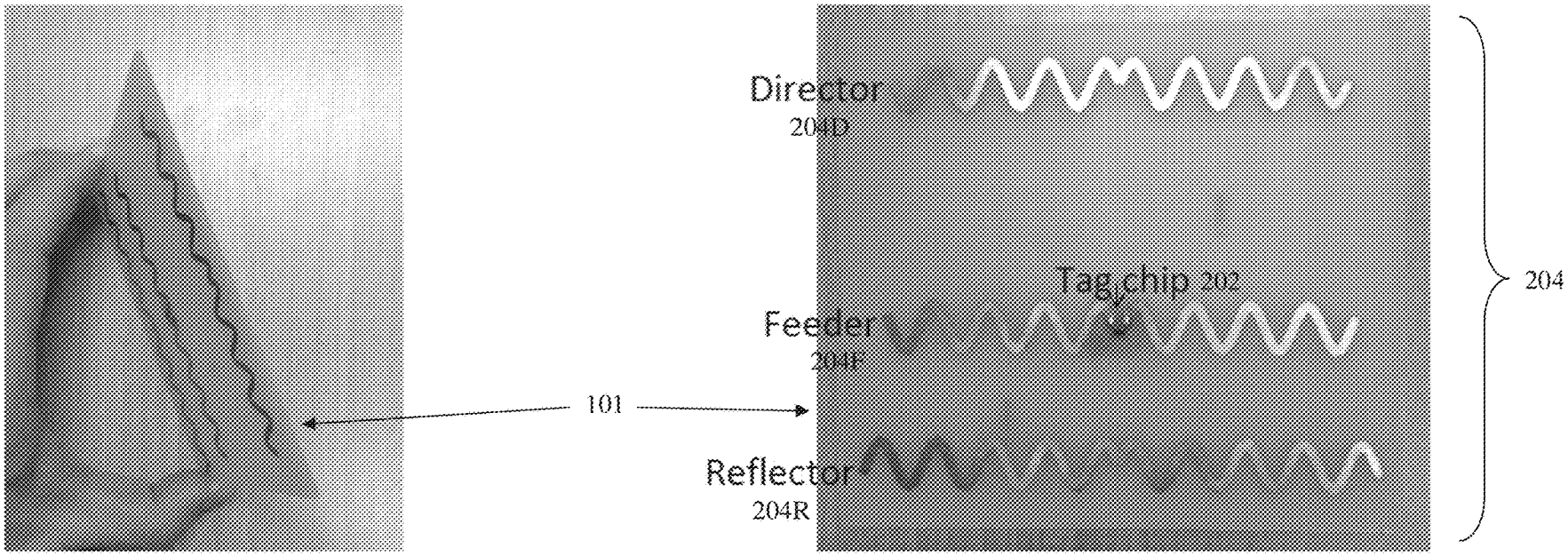
FIG. 2A is a perspective view of an example of the radio communication device of FIG. 1.
FIG. 2B is a front view of the radio communication device of FIG. 2A.

With reference to FIGS. 2A and 2B, the planar body 101 is shown in more detail with a radio communication chip 202 disposed thereon. As illustrated in FIGS. 2A and 2B, the chip 202 may be a Radio Frequency Identification (RFID) circuit that can facilitate RFID communications with an external reader. This RFID chip 202 can be connected to an antenna arrangement 204 so as to allow radio communication signals to be transmitted and received by the RFID chip 202. Preferably, the antenna arrangement 204 fits with the thin profile of the planar body as shown such that the radio communication device 100 can fit snugly within narrow cavities that are formed when different building components are joined, laid or otherwise placed together.

In this example embodiment, the antenna arrangement 204 includes a feeder antenna 204F which is connected to the RFID circuit 202. To improve the signal transmission characteristic of this feeder antenna 204F, a reflector 204R is placed at the lower end of the planar body 101, whilst a director 204D is placed at the opposite end (the upper end) of the planar body 101. In turn, the layout of the feeder antenna 204F, the reflector 204R and the director 204D may take the form of a Yagi antenna, which is one implementation of an end-fire array antenna. The effect of this antenna arrangement 204 is that the radio signals will generally radiate from the feeder 204F antenna upwardly and in the direction of the director 204D and thus creating the effect of a substantially uni-directional radiation. This is advantageous in that the radio signals may be radiated in a particular desired direction, such as upwardly from a walkway and into a space in which the user is likely to walk or stand within.

Preferably, as shown in this embodiment, the feeder 204F, reflector 204R and director 204D are conductive tracks which are placed onto the planar body 101, and thus maintaining the thin profile of the planar body 101. As is the case with an end-fire array antenna, the reflector 204R track is slightly wider than the feeder track 204F and the director track 204D, with the reflector 204R and director 204D track being electrically coupled with the feeder 204F. In turn, when the radio communication device is inserted into a narrow gap, such as a gap in a walkway, wall or ceiling with the lower end being inserted into the gap and its upper end being placed in the direction of a user accessible area, such as a walkway or chamber, the radiation of the antenna arrangement would see that the radio signals are radiated substantially into the walkway or chamber and thus accessible by a user's radio communication device.

Figure 3:
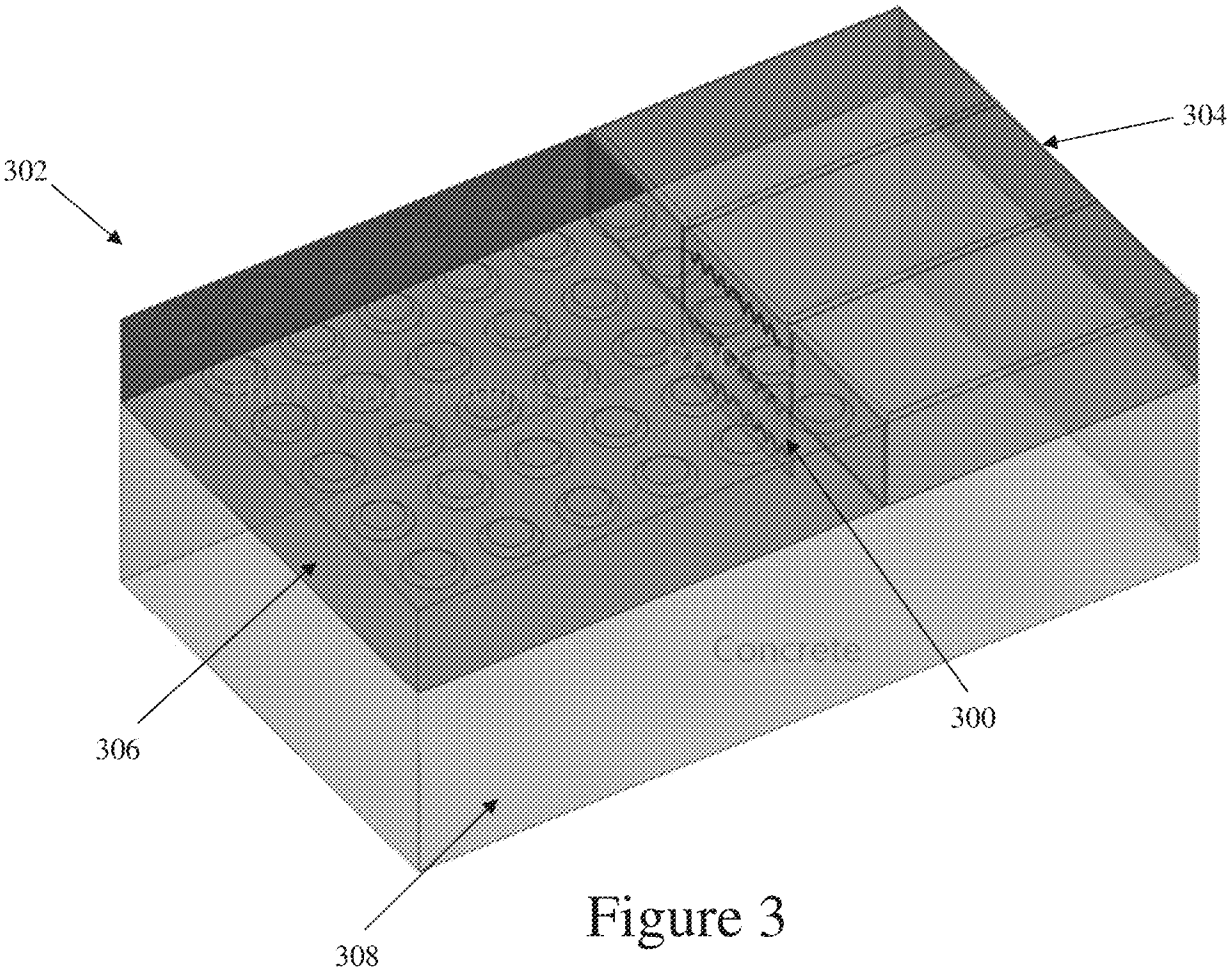
FIG. 3 is a perspective diagram illustrating an example installation of the radio communication device of FIG. 1 in a path or walkway.

With reference to FIG. 3, there is illustrated an example installation of the radio communication device 300 in a walkway 302 that may be used by visually impaired users. In this example, the radio communication device 300 is placed between a gap in the walkway 302, which in turn is defined by a brick 304 and a tactile guiding tile 306 which are placed on a concrete surface 308. This arrangement of flooring components 304, 306 and 308 is typical of many walkways found in buildings or common infrastructures such as bus stops, railway stations or pedestrian tunnels and bridges. As shown, the radio communication device 300 is inserted into the gap between the brick 304 and the tactile guiding tile 306 which are formed when the brick and the guiding tile are laid onto the concrete surface 308. In turn, users with radio communication readers accessing the walkway will be able to communicate with the radio communication device so as to receive information or instructions. Visually impaired users may also be guided by the tactile guiding tile 306 and thus by having the radio communication device 300 being installed near the tactile guiding tile 306 will assist visually impaired persons in accessing the radio communication device 300.

Figure 4:
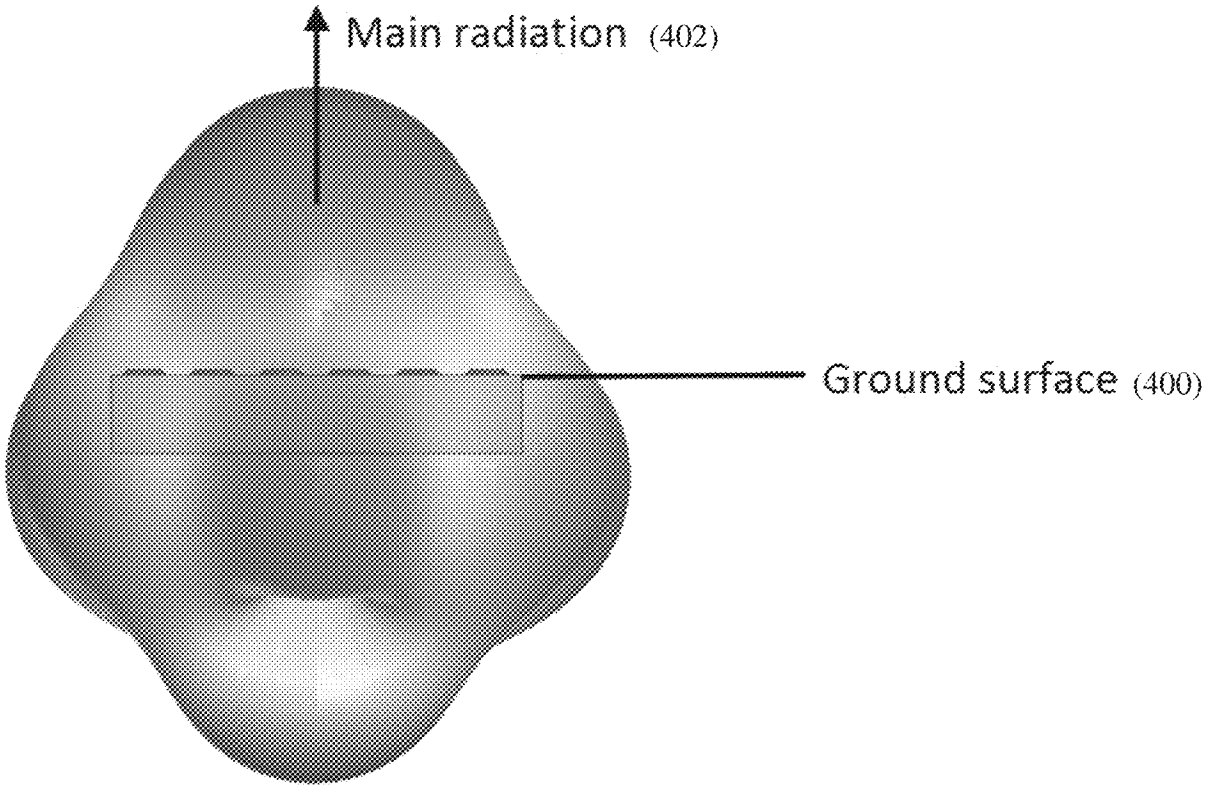
FIG. 4 is a diagram illustrating the radiation pattern of the radio communication device of FIG. 1.

With reference to FIG. 4, there is illustrated a chart illustrating the field strength of the radio signals as radiated from different embodiments of the radio communication device 100, 200 and 300. As shown, since the radio communication device 100, 200 and 300 preferably includes an end-fire array antenna or a generally uni-directional antenna arrangement, the signals are radiated (402) towards the user's reader devices more so than into the ground surface 400. This is advantageous as it can provide a stronger signal for reading by a user's reader device whilst also minimizing signal noise in areas where the signal would not be relevant. Typically, walkways in multi-stories buildings would benefit significantly as radio communication devices on adjacent floors are unlikely to transmit a strong signal to the floors below, and thus minimizing errors in users reading a signal for an incorrect floor.

Figure 5:
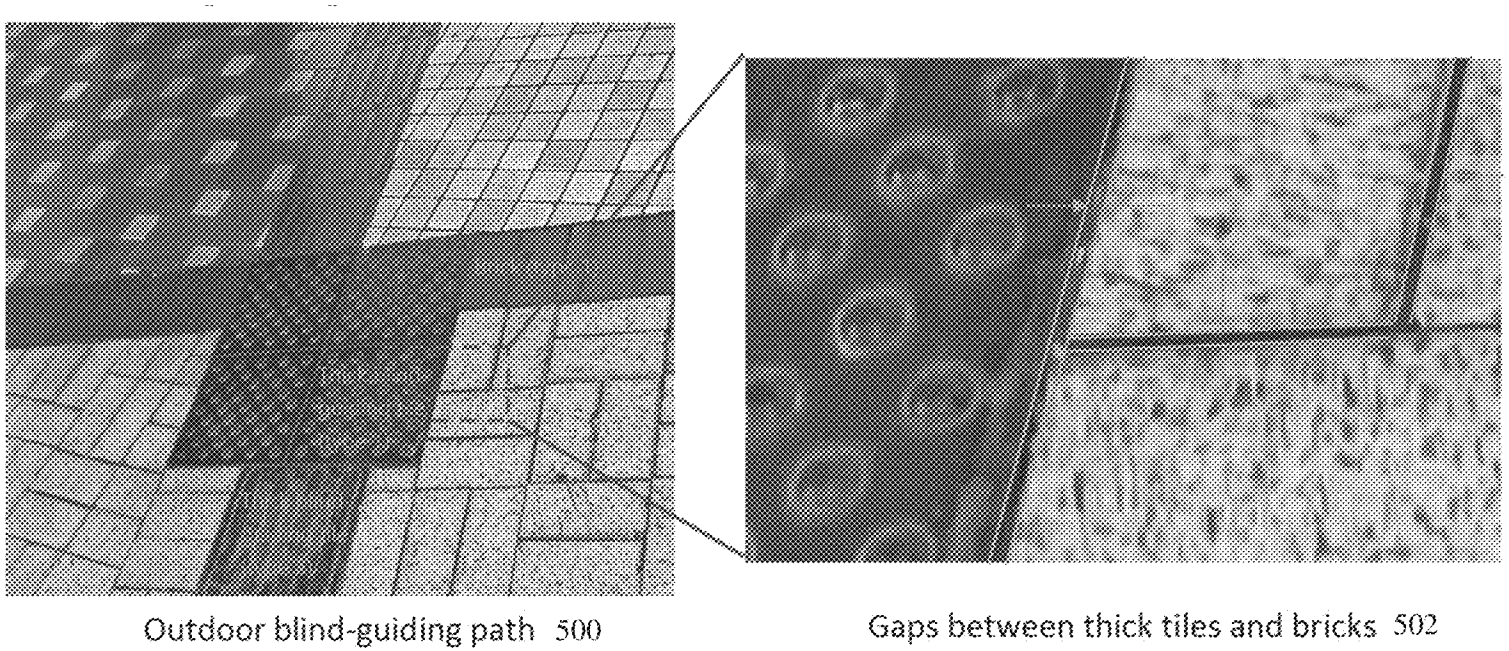
FIG. 5 is an illustration of an example installation location of the radio communication device on a path or walkway.

With reference to FIG. 5, there is illustrated an example installation of the radio communication device in a typical walkway 500. In this illustration, a typical walkway may include a number of bricks or tiles, which are laid over a concrete floor. Additionally, tactile guide tiles may also be laid so as to form a tactile path for visually impaired users.

As these bricks or tiles are laid, gaps 502 are formed in between each of these components. These gaps 502 may sometimes be filled with an adhesive such as cement, or other building type materials. The gaps 502 are usually narrow and are only a few millimetres thick. It is within these gaps that the radio communication device can be installed within, with the correct method of installation to have a substantial portion of the radio signals to radiate away from the ground surface.

The embodiments of the present invention may be advantageous in that it is known from the research and trials of the inventors that it is difficult to maintain good radio communication performance in many different environments. This is due to the fact that in these environments, tactile guiding tiles may be very thick, and other building components may also cause blockage or absorption of radio signals. Furthermore, in outdoor walkways, there is also a significant meteorological effect on radio signals which can cause signals to become weak or unreadable. However, in the example embodiments described herein, at least some of these problems can be addressed by providing a stronger signal in a specific desired direction.

Furthermore, known methods of installing radio frequency interfaces in walkways or other buildings or infrastructure is also costly and undesirable. Existing methods of installing radio frequency interfaces may include the burying of radio devices into the ground. This creates a significant effort as existing walkways may need to be reworked with existing brickwork or tile work to be dug up and re-laid. Furthermore, specific designed tiles may be fabricated so as to allow these radio devices to fit within it. However, embodiments of the invention are designed to fit within existing gaps that are formed in existing brick and tile work, with minimal rework of these floors required to install these radio communication devices and thus reducing the costs of deployment.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive.

Any reference to prior art contained herein is not to be taken as an admission that the information is common general knowledge, unless otherwise indicated.

The invention claimed is:

1. A radio communication device comprising:

a planar body arranged to be inserted into a gap portion between one or more construction components, wherein the planar body includes a radio communication chip and an antenna arrangement arranged to radiate radio communication signals from the radio communication chip in a direction away from the gap portion;

wherein the antenna arrangement is disposed onto the planar body and is arranged to radiate the radio communication signals primarily in a single direction that is upwards from a ground surface or outwards from a ceiling or wall surface; and wherein the one or more construction components include tiles or bricks, and the gap portion is defined by the cavities formed in between adjacent bricks or tiles which are placed on and covering the ground surface, ceiling or wall surface, and when the planar body is inserted into the gap portion, the planar body is perpendicular to the ground surface, ceiling or wall surface.

2. A radio communication device in accordance with claim 1, wherein the direction away from the gap portion is parallel with a longitudinal axis of the gap portion.

3. A radio communication device in accordance with claim 1, wherein the planar body has a thin profile so as to be inserted into the gap portion.

4. A radio communication device in accordance with claim 1, wherein the antenna arrangement is an end-fire array antenna.

5. A radio communication device in accordance with claim 4, wherein the end-fire array antenna is defined on the planar body with a feeder element connected to the radio communication chip, a reflector element and/or a director element.

6. A radio communication device in accordance with claim 5, wherein the feeder element, reflector element and/or director element are arranged as a yagi antenna.

7. A RFID device for assisting visually impaired users comprising:

a planar body arranged to be inserted into a gap portion between one or more flooring components covering a ground surface, wherein the planar body includes a radio communication chip and an antenna arrangement arranged to radiate radio communication signals from the RFID chip upwardly in a direction away from the ground surface;

wherein the antenna arrangement is disposed into the planar body and is arranged to radiate the radio communication signals primarily in one direction; and wherein the one or more flooring components include tactile guiding tiles, and the RFID device is arranged to be placed adjacent to the tactile guiding tiles and to be perpendicular to the ground surface when the RFID device is inserted into the gap portion.

8. A RFID device for assisting visually impaired users in accordance with claim 7, wherein the antenna arrangement is an end-fire array antenna.

9. A RFID device for assisting visually impaired users in accordance with claim 7, wherein the RFID chip is arranged to communicate with a device arranged to use an RFID arrangement to assist a visually impaired person.

10. A method for installing a RFID device into a surface comprising the step of:

Placing the RFID device into a gap between two or more abutting flooring components, wherein the RFID device is substantially planar and is arranged to radiate a radio signal in a direction away from the surface;

wherein the RFID device includes an antenna arrangement, which is disposed onto the RFID device and is arranged to radiate the radio signal primarily in one direction that is upwards from the surface; and wherein the two or more abutting flooring components include tactile guiding tiles, and the RFID device is arranged to be placed adjacent to the tactile guiding tiles and to be perpendicular to the ground surface when the RFID device is inserted into the gap portion.

* * * * *